US006007121A

United States Patent [19]

Dreisbach et al.

[11] Patent Number: 6,007,121

[45] Date of Patent: Dec. 28, 1999

[54] ROTATABLE SEAL

[75] Inventors: Richard Dreisbach, North Arlington; George Albert Lundberg, Jr., Pompton Plains; Robert J. Finamore, Wayne, all of N.J.

[73] Assignee: E. J. Brooks Company, Livingston, N.J.

[21] Appl. No.: 09/203,980

[22] Filed: Dec. 2, 1998

[51] Int. Cl.[6] ..... B65D 33/34

[52] U.S. Cl. ..... 292/307 R; 292/315

[58] Field of Search ..... 292/307 A, 307 R, 292/307 B, 315, 326, 325; 24/909; 242/388.1, 388.2, 388.3, 383

[56] References Cited

U.S. PATENT DOCUMENTS

| | | | |
|---|---|---|---|
| 421,951 | 2/1890 | MacCarthy . | |
| 1,054,436 | 2/1913 | MacHang . | |
| 1,826,033 | 10/1931 | Webster . | |
| 1,911,060 | 5/1933 | Clark . | |
| 1,977,301 | 10/1934 | Bradford . | |
| 2,587,876 | 3/1952 | Moore | 292/315 |
| 4,978,026 | 12/1990 | Gnoinski . | |
| 5,180,200 | 1/1993 | Georgopoulos et al. . | |
| 5,402,958 | 4/1995 | Mahaney | 242/388 |
| 5,419,599 | 5/1995 | Georgopoulos . | |

*Primary Examiner*—Darnell M. Boucher
*Assistant Examiner*—Gary Estremsky
*Attorney, Agent, or Firm*—John G. Gilfillan, IIII.; William Squire

[57] ABSTRACT

A thermoplastic housing has a chamber open at one end and a bottom wall at the other end. A thermoplastic rotor is locked axially in the chamber by a snap fitting ridge and groove. A one or more bores are in the housing bottom wall in communication with the chamber. The rotor has a central boss with one or more bores aligned with the housing bores in an initial position of the rotor and includes an outer ring with axially depending radially flexible pawls which engage housing ratchet teeth in the chamber. The pawls and teeth rotationally lock the rotor relative to the housing in one direction while seal filament segments inserted in the aligned bores are twisted about each other or about a post in the cavity. The rotor is rotated relative to the housing manually by finger gripped-flanges attached to the rotor and to the housing. The rotor ring and boss are spaced by a weakening groove which causes the boss to permanently separate from the ring when the filament is pulled in an attempt to defeat the seal.

23 Claims, 4 Drawing Sheets

ROTATABLE SEAL

CROSS-REFERENCE TO RELATED APPLICATION AND PATENTS

Of interest are commonly owned copending application Ser. No. 09/070,055 entitled Rotatable Seal filed Apr. 30, 1998 in the name of Jeremy Leon et al. and U.S. Pat. Nos. 4,978,026, 5,180,200 and 5,419,599 relating to rotatable seals.

This invention relates to rotatable seals for securing containers and for preventing removal of sealing wire from a hasp, staple or similar member of a lock or latch which secures a container and is destroyed when removed.

Various devices for sealing the hasps or staples of locks or latches which secure cargo containers or other arrangements comprise an elongated, flexible sealing wire, typically stranded and relatively fine gauge and a metal or thermoplastic seal. The wire is passed through the hasp or staple and then its ends are retained by the seal which is crimped or deformed to prevent removal of the wire ends. Since the presence of the wire prevents operation of the hasp or staple, unauthorized entry into the container entails destroying the seal or the wire creating visual evidence of the unauthorized entry.

Examples of prior art seals may be found in U.S. Pat. Nos. 421,951, 1,826,033 and 1,911,060.

U.S. Pat. No. 421,951 discloses a rotatable seal lock wherein a strip seal is inserted within a rotatable member. Thereafter the member is rotated causing a dog to be received within an opening in the strip and pulled within the rotatable member to a retained position. The rotatable member is held against unlocking rotation by the use of a spring-loaded pawl.

U.S. Pat. No. 1,826,033 discloses a block with a sealing chamber with transverse holes. A roller is in the chamber and has a cross-partition for temporary engagement with a winding means inserted through the chamber. The winding means has holes to receive a sealing band.

U.S. Pat. No. 1,911,060 discloses a sealing device having a body with apertures through which a flexible sealing means can extend. The center portion of the body is provided with a threaded bore which is intersected by the apertures. Disposed within the threaded bore is a unirotational screw which may be tightened down against the flexible securing means to retain it in a sealed position.

The aforementioned, commonly owned U.S. Pat. Nos. 4,978,026, 5,180,200 and 5,419,599 provide a seal for securing a container and provide evidence of tampering as well as being economical to manufacture. In the U.S. Pat. No. 5,180,200 seal, a rotatable rotor is insertable in a chamber in a thermoplastic housing. The housing wall contains bores aligned across the chamber. The housing wall further has two annular grooves adjacent the chamber entrance. The rotor has a bore and two annular ridges, curved in transverse section complementary to the grooves, near its top. The rotor is partially inserted in the housing by snapping the lower ridge into the upper groove of the chamber and locating the tabs on the housing in relieved areas to align the bores so that a seal wire may be inserted through the aligned bores. With a seal wire inserted, the rotor and housing are relatively rotated to wrap the wire about the rotor. The rotor is then fully axially inserted into the housing so that each ridge snaps into a groove. This and engagement of teeth on the bottom of the rotor which mate with teeth at the chamber base prevent removal of the rotor from the housing, prevent relative rotor-housing rotation, and prevent removal of the wire from the seal.

However, the rotor is only partially inserted when it receives a sealing wire after which the rotor is rotated and then fully inserted. The rotation of the rotor to wrap the wire thereabout and fully insert the rotor into the chamber requires a special tool.

U.S. Pat. No. 5,419,599 ('599) discloses a seal similar to that in U.S. Pat. No. 5,180,200 except a ratchet and pawl mechanism permit relative rotation of the rotor to the housing in only one direction when the rotor is fully inserted. Also, a screw driver can rotate the seal without a special tool.

U.S. Pat. No. 5,402,958 discloses a seal with a ratchet and pawl mechanism similar to that in the '599 patent. Like that seal, this patent seal requires a screw driver or similar tool to rotate the seal rotor to wrap the wire about the rotor and lock the seal. Also, like the other patents discussed above, mating curved in transverse section ridges and grooves axially lock the rotor in the housing chamber. These grooves and ridges, however, have arcuate surfaces which may be defeatable by tampering.

The aforementioned copending application provides a rotatable seal which requires no tools to operate. A flange on the rotor and projections on the housing can be manually gripped to permit relative rotation of the rotor and housing. The manual rotation of the rotor relative to the housing wraps the wire or filament about the rotor in an annular channel provided for that purpose. In addition, one end of the filament can be secured to the seal at the factory while not interfering with the use of the rotor in the field.

The present inventors recognize a further need for a seal wherein the wire filament can be secured without tools. In addition a need is seen for a seal wherein one or more wires can be secured to the same seal and without tools, and wherein the wires can be secured at one end to the seal for use by an end user.

A rotatable security seal according to the present invention comprises a housing having a bottom wall and an annular side wall defining a chamber having an axis, said chamber being open at the housing top distal the bottom wall, said bottom wall having a first through-bore for receiving therethrough a flexible filament in an axial direction corresponding to said axis.

A rotor is in the chamber for rotation about said axis relative to the housing and enclosing the top, the rotor having a second through-bore for receiving therethrough said received filament. One way rotation means are coupled to the rotor and to the housing for permitting the rotor to rotate about the axis only in one direction relative to the housing to twist the received filament in the chamber between the rotor and the housing.

In one aspect, rotor locking means are coupled to the rotor and to the housing in the chamber for axially securing the rotor in the chamber.

In another aspect, a post is secured to one of said rotor and housing in said chamber for receiving said twist of said filament wrapped thereabout.

The bores each are preferably in a further aspect dimensioned relative to said filament for receiving a plurality of side-by-side filament portions therethrough.

The one way rotation means may comprise ratchet teeth extending from one of the side wall and rotor into said chamber and at least one resilient pawl secured to the other of the rotor and side wall for engagement with the ratchet teeth.

In a still further aspect, te rotor has a top wall from which depends an outer wall and a central boss and weakening means are in said rotor for weakening said boss relative to said outer wall.

In a further aspect, the twisted filament has a twisted section, said rotor having a central boss through which said second bore passes, said central boss being spaced from said housing bottom wall for providing a cavity in the chamber for receiving said twisted section.

In a further aspect, the post has sides forming angular corners about which the filament is twisted.

In a still further aspect, a plurality of said first bores are in said bottom wall and a plurality of said second bores are in said rotor, said first and second bores having an axially aligned condition in one angular position of said rotor.

A rotatable security seal according to the present invention comprises a housing having a bottom wall and an annular side wall defining a chamber having an axis, the chamber being open at the housing top distal the bottom wall, the bottom wall having first and second through-bores for receiving therethrough a flexible filament in an axial direction. A rotor is in the chamber for rotation about the axis relative to the housing, the rotor having third and fourth through-bores for receiving therethrough the received filament. Rotor locking means are coupled to the rotor and to the housing in the chamber for axially securing the rotor in the chamber. One way rotation means are coupled to the rotor and to the housing for permitting the rotor to rotate about the axis only in one direction relative to the housing to twist the received filament in the chamber between the rotor and the housing.

IN THE DRAWING

Figure 1:
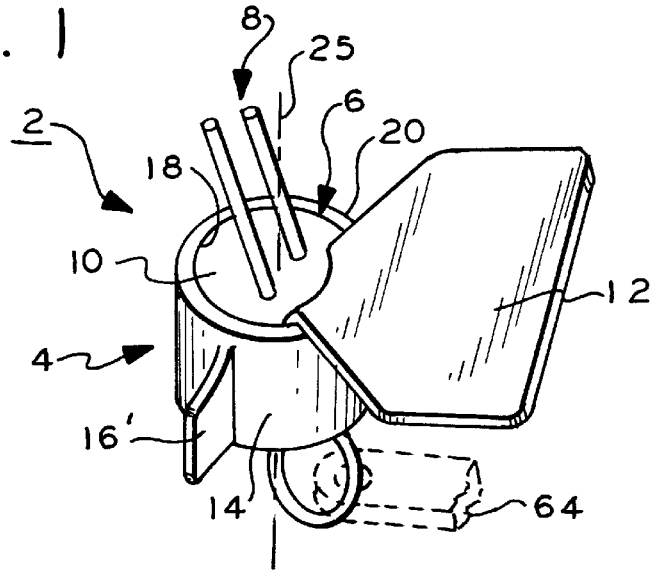
FIG. 1 is an isometric view of a seal according to an embodiment of the present invention.
Figure 2:
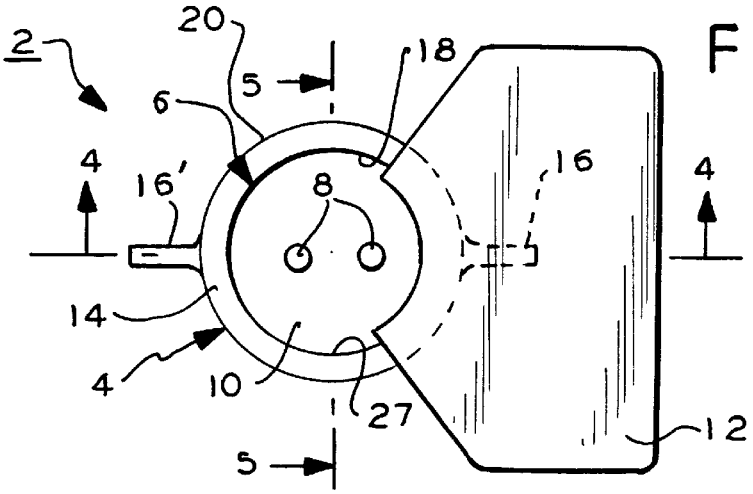
FIG. 2 is a top plan view of the seal of FIG. 1.

Rotatable seal 2, FIGS. 1–2, includes a preferably circular cylindrical female housing 4, a male rotor 6, and a flexible locking filament 8, preferably stranded metal wire or a thermoplastic monofilament size-on-size. The term filament as used herein is intended to include monofilaments of thermoplastic material, solid metal wire or solid strands of non-metallic material and stranded cables of metal or non-metallic fibers. The drawing figures illustrate the filament 8 as a stranded metal wire cable by way of example.

The term "size-on-size" refers to the diameter of the filament as having a dimension that is variable in value from a maximum dimension (zero upward tolerance) to a minimum dimension or negative tolerance range. For example, a 0.010 inch (0.254 mm) size-on-size monofilament has a maximum diameter of 0.010+0.0 inches and a minimum value that may be 0.010−xxx inches. The stranded wire filament 8 is preferably about 0.030 inches (0.76 mm) in diameter in this embodiment. The monofilament is preferably 0.010 inches in diameter. The housing 4 and rotor 6 are both preferably molded one piece frangible thermoplastic, but may be other materials.

Figure 4:
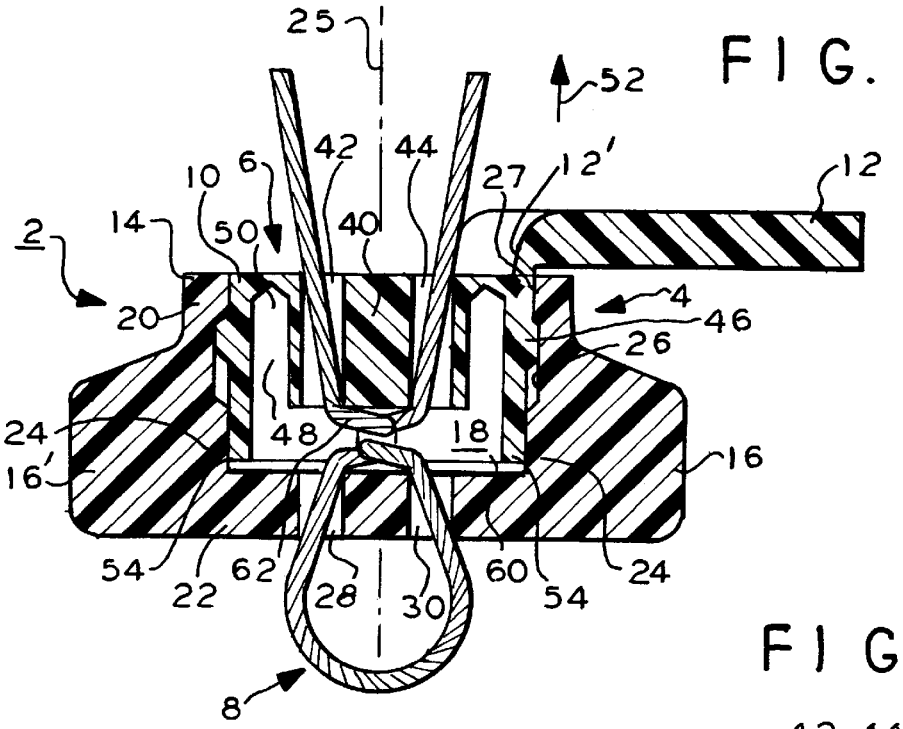
FIG. 4 is a side elevation sectional view of the seal of FIG. 2 taken along lines 4—4 with a stranded wire filament attached in a locked condition.
Figure 6:
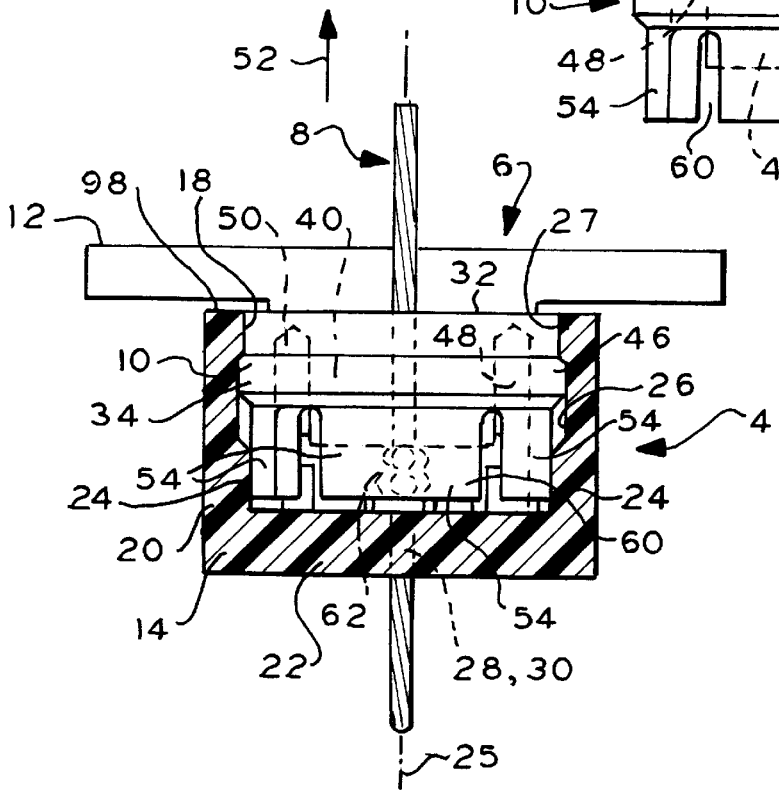
FIG. 6 is a side elevation view of the rotor and a side elevation sectional view of the housing of the seal of FIG. 2 taken along lines 5—5 with a stranded wire filament attached in a locked condition.
Figure 7:
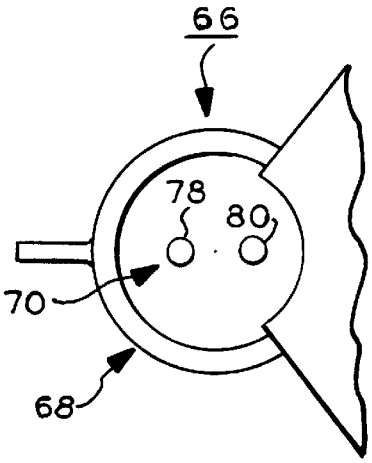
FIG. 7 is a fragmented top plan view of a seal in accordance with a second embodiment of the present invention.
Figure 8:
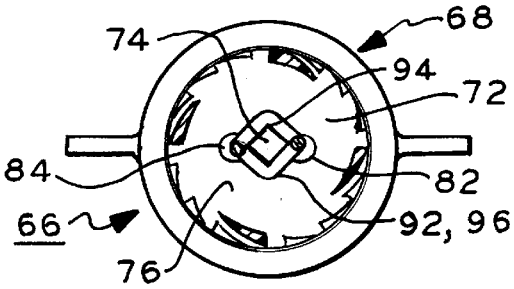
FIG. 8 is a top plan of the housing and sectional view of the inserted rotor of the embodiment of FIG. 7 with a sealing wire attached.

The housing 4, FIGS. 4 and 6, preferably has a generally circular cylindrical hollow body 14 and a pair of identical radially outwardly extending planar flanges 16, 16' extending from opposite sides of the body 14. The housing exterior may be any desired shape, but preferably is circular cylindrical. The housing body 14 has a generally cylindrical chamber 18 in which the rotor body 10 is rotatably seated.

The housing 4, FIGS. 1–4, has a generally circular cylindrical side wall 20 enclosing circular in cross-section chamber 18 which is closed at one end by a bottom wall 22. Formed in the side wall 20 and in the bottom wall 22 at their junction projecting into chamber 18 are a plurality of circumferential spaced ratchet teeth 24. The teeth 24 extend axially parallel to longitudinal axis 25 of the chamber 18 normal to the bottom wall 22. Each tooth 24, FIG. 3, each has a gradual trailing rake 24*a* and a steep leading rake 24*b*. The depth of the teeth 24 (the radial depth of rake 24*b* from central axis 25) is not critical, and the function of the teeth will be described in more detail below.

In this embodiment, the teeth 24 each subtend an angle of about 22.5° and have radially interior surfaces that are preferably circular segments and are parallel to axis 25. The teeth 24, FIG. 4, preferably extend axially along axis 25 for approximately one third the axial depth of the chamber 18 between annular groove 26 in side wall 20 and bottom wall 22. The teeth 24 terminate at the junction of the bottom wall 22 with the side wall 20.

Figure 3:
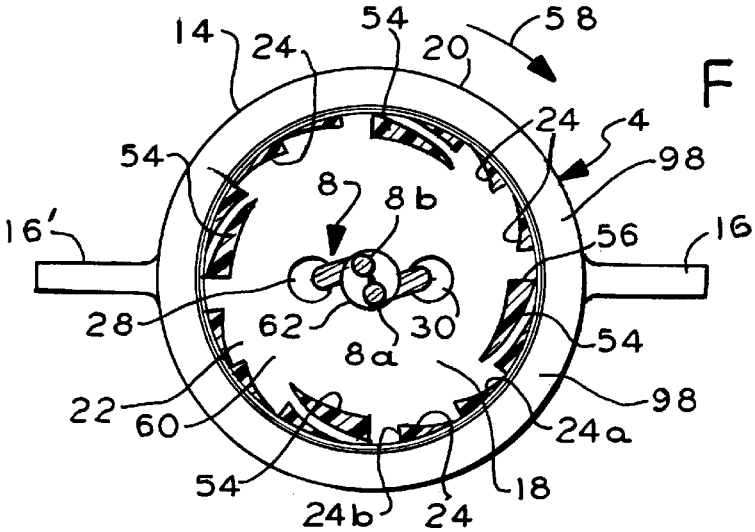
FIG. 3 is a top plan view of the housing of the seal of FIG. 2 with a sectional view taken through the pawls of the rotor with a twisted filament attached

The annular groove 26 is in the interior surface of the wall 20 interior the chamber 18. The groove 26 has edges that flare upwardly toward the opening 27 to the chamber 18 and downwardly toward the bottom wall inclined relative to the axis 25. In FIG. 3, formed through the bottom wall 22 is a pair of bores 28, 30 symmetrical and coplanar relative to the axis 25. The bores 28 and 30 are of like diameter, preferably 0.062 inches (1.6 mm) for use with a stranded wire filament of about 0.030 inch diameter, for example.

Figure 5:
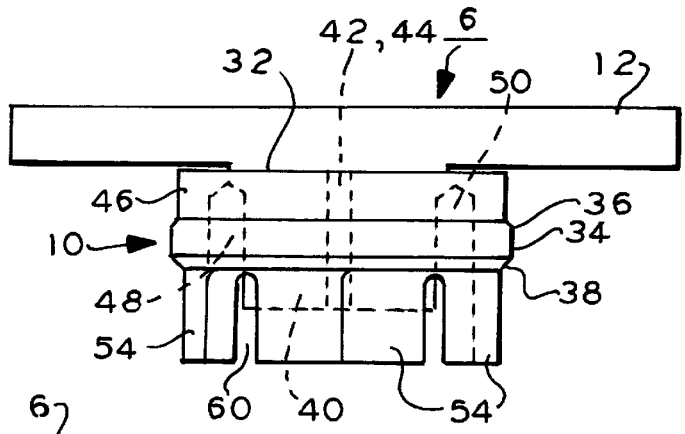
FIG. 5 is a side elevation view of the rotor of the seal of FIGS. 1 and 2 without the filament in place.

The rotor 6, FIG. 5, includes a body 10 and a manually operated finger gripped flange 12 secured to the body and sometimes referred to as flag. The flange 12 may also be imprinted with manufacturer data such as a serial number bar code, nomenclature and the like. The flange 12 is used to rotate the rotor relative to the housing 4.

The rotor 6 is shown in more detail in FIGS. 3, 5 and 6. The rotor 6 is generally circular cylindrical. The rotor 6 includes a disc-like head 32. Flange 12, which is sheet-like, extends from the head 32 and is molded one piece therewith. An annular outer ridge 34 is formed one piece with the rotor and has inclined edges 36 and 38. The ridge 34 is generally complementary to and engages the groove 26 in the housing 4 (FIG. 3) in snap fit relation. The ridge 34 has an axial extent that is shorter than the axial extent of groove 26. In the alternative, a groove (not shown) may be formed in the rotor and a complementary ridge formed in the housing 4 wall 20.

Circular cylindrical central boss 40 is integral one piece with and depends from the head 32. A pair of through-bores 42 and 44 are in the boss 40 parallel to axis 25 and aligned with bores 28 and 30 in the housing 4 in the initial state of the rotor 6. The bores 42 and 44 are preferably the same diameter as the bores 28 and 30. An outer circular cylindrical ring 46 depends from and is one piece with the head 32. The ridge 34 extends radially outwardly of the ring 46. The ring 46 is spaced from the central boss 40 by an annular recess 48.

The recess 48 terminates in head 32 with an annular V-shaped groove 50. Groove 50 serves to weaken the head 32 so that a force on the boss 40 in direction 52 by pulling on the locked filament 8 will sever the boss 40 at the groove 50 from the rest of the rotor 6. The ridge 34 locks the rotor 6 to the housing groove 26 so that only the central boss 40 will be pulled in direction 52 in response to the pulling force thereon. That is, the weakening groove 50 causes the head 32 to fracture at the groove 50 in response to such pulling forces separating the boss 40 from the ring 46.

In FIGS. 3–6, a plurality of annularly spaced identical radially resilient pawls 54, preferably four in this embodiment, axially depend from the ring 46. The pawls 54 extend generally in a circumferential direction and are generally circular segments of somewhat triangular shape in transverse section as seen in FIG. 3. The pawls 54 each have a radially extending forward rake 56. Rake 56 locks against rake 24*b* of the ratchet teeth 24 to prohibit counterclockwise rotation of the rotor 6 in FIG. 3 about the axis 25 (FIG. 3). The pawls at the rake 56 region are radially resilient.

In FIG. 3, when the rotor 6 is rotated in clockwise direction 58 relative to the housing 4, the pawls 54 resiliently deflect radially inwardly as they engage and slide along the ratchet teeth 24. However, reverse rotation of the rotor 6 is precluded by the one way action of the engagement of the rakes 56 and 24*b* of the respective pawls 54 and ratchet teeth 24. In FIGS. 4 and 6, the pawls 54 depend in the axial direction of axis 25 radially aligned with the ratchet teeth 24.

The boss 40, FIG. 4, terminates spaced from the housing bottom wall 22 a distance to provide a cavity 60 in the chamber 18. This cavity 60 is of sufficient axial depth to permit at least several twists 62, which extend in an axial direction, of the filament 8 to be located in the cavity 60.

When the pawls 54 are aligned coplanar with ratchet teeth 24, FIGS. 4 and 6, the rotor 6 can only rotate in one angular direction about the axis 25 due to the engagement of the pawls 54 with the ratchet teeth 24. As the rotor 6 rotates in the clockwise direction 58, FIG. 3, the pawls 54 flex radially inwardly in a plane permitting relative rotation of the rotor. Normally, the quiescent state of teeth 24 is such that pawls 54 lock in engagement with teeth 24, preventing reverse rotation. As the rotor 6 rotates, the pawls 54 ride up the ramp formed by teeth 24 rake 24*a* and flex radially inwardly. The teeth 68 then snap return to the state shown when in this relative position.

The rotor 6 is fully inserted axially into the chamber 18 to the axial position shown in FIGS. 4 and 6. The ridge 34 is axially snapped into the groove 26. The diametric differences between the ridge 34 and the mating respective groove 26 is such that the rotor 6 is easily rotated within the chamber 18 relative to the housing 4 in direction 58, but is also locked axially in chamber 18 along axis 25.

The pawls 54 are complementary to the teeth 24 in the chamber 18, the teeth and pawls having sufficient clearance so that upon insertion of the rotor 6 into the chamber 18 they are aligned coplanar and engaged. This engagement may be provided by simultaneous rotation of the rotor 6 relative to the housing 4 during axial insertion of the rotor into chamber 18. The pawls 54 outer surfaces may taper radially inwardly in a direction toward axis 25 and toward the rotor bottom wall 22 to assist in insertion of the rotor 6 into engagement with the teeth 24.

When the rotor 6 is fully inserted into the housing 4 and the ridge 34 is seated in the groove 26, the teeth 24 and pawls 54 mesh and prevent relative rotation of the housing 4 and the rotor 6 in a direction opposite direction 58.

When the rotor 6 is inserted into the chamber 18, FIG. 4, the bores 42 and 44 of the rotor are axially aligned with the respective bores 28 and 30 of the housing 4. The rotor 6 may be rotated to align the bores to the position shown. The flanges 16, 16', FIG. 2, may serve as alignment devices to assist in visually aligning the rotor bores to the housing 4 bores.

In operation, after the rotor is inserted into the chamber 18, the filament 8 is then inserted into the aligned bores with a loop passed through a hasp 64, FIG. 1, to be secured.

Relative rotation of the rotor 6, FIG. 3, to the housing 4 twists the two side-by-side filament 8 segments 8*a* and 8*b* about each other. This forms axially extending twisted portions of twists 62 wrapped about each other. The cavity 60 has an axial extent sufficient to receive the twists 62. The filament 8, FIG. 4, has relatively sharp 180° bends at the junction between the rotor bores 42 and 44 and the rotor boss 40 bottom external surface in the cavity 60. These sharp bends lock the filament 8 to the rotor and prevent both removal of the filament 8 from the seal 2 and opening of the seal 2. To provide enhanced digging into the filament at the bottom corner junction of the rotor bores and boss 40 bottom surface, the bores 42 and 44 may be spaced further apart. The greater this spacing, the more the bend of the filament at this junction approaches a right angle.

A right angle enhances digging into the filament and provides increased resistance to axial slipping of the filament in response to an axial pulling force on the filament 8. The rotor 6 is made sufficiently hard to preclude damage thereto in response to pulling extraction forces on the filament 8. Also, a relatively small diameter filament as compared to the spacing between the rotor bores may provide such a desired sharp bend. The bend angle at the bottom corner of the bores 42 and 44 may be made acute if desired by making the bottom surface of the boss 40 forming cavity 60 recessed such as with a depression (not shown) which may be spherical, conical and the like. The twists may then be located, partially or fully, in such a recess resulting in a bending of the filament at an acute angle to further resist extraction by a pulling force thereon.

When the rotor is fully inserted in the housing, FIGS. 3 and 5, the upper surface of head 32 of the rotor 6 is preferably coplanar with the housing 4 upper surface 98 and forms a smooth surface with the upper surface 98. Such smooth surface makes it difficult for tampering action to separate the rotor 6 from the housing 4 after axially locking the rotor in the housing 4 chamber 18. No tool is needed or used to rotate the rotor. The rotor is easily manually rotated with the filament in place to provide multiple twists of the filament.

Other features of the seal 2 may also contribute to obviating disassembly of the seal 2. The teeth 24 and pawls 54 help to defeat opening of the seal 2 by permitting only further twisting of the filament and no untwisting. When a maximum number of twists are formed, the rotor can not be further rotated. Should the flanges be broken during such attempts to open the seal, such will indicate tampering without defeating the sealing action. For example, flange 12, FIG. 4, has weakened section 12' which fractures if stressed excessively. If the flange 12 is used in an attempt to withdraw the rotor 6, the flange will fracture at section 12'. This prevents defeating the seal.

If the rotor 24 and housing 22 are, as preferred, molded from frangible thermoplastic, attempts to tamper with the seal 2 will be evident by the chipping, cracking or crazing thereof following the application of tampering forces.

The housing 4 and rotor 6 of the rotatable seal 2 may be made from strong and essentially semi-rigid materials such as metal, rubber, plastics, etc. A preferred material is acrylic plastic but may be what are referred to as engineered plastics having relatively high melt and strength parameters. The housing 4 and rotor 6 of the rotatable seal 2 may also be made from clear materials. This permits visual alignment of the rotor bores 42, 44 with the respective housing bores 28, 30. Also, the positive locking of the seal filament 8 can be inspected and provide a visual indication of tampering.

When the filament 8 is a monofilament of size-on-size, it may have an outer diameter that is closely matched to the diameter of the various bores. This permits closer tolerances of the bores to the filament to further resist tampering.

When the seal 2 is in the locked condition, the interfitting rotor 6 and housing 4 must be destroyed, or the seal filament 8 cut to remove the seal 2 from the hasp 64 so that the hasp members can be moved or operated. Due to the strong materials of construction, substantial effort is required either to destroy the housing 4 and rotor 6 or to cut the filament 8. However, if such destruction or cutting is effected, there is provided an easily detectable indication of tampering.

In FIGS. 7–9 and 15, a second embodiment of a seal 66 according to the present invention includes a housing 68 and a rotor 70. The seal 66 housing is generally identical to the housing 4, FIGS. 1–6, except, bottom wall 72 includes a central upstanding post 74 located in cavity 76. The post 74 is molded one piece integral with the housing 68. In this embodiment the post 74 has a square profile in plan view, FIG. 8. In the alternative it may be triangular, or multifaceted or circular, the latter not being preferred.

The rotor 70 includes two bores 78 and 80 which align with two mating bores 82 and 84 in the housing bottom wall 72. The rotor 70 and housing 68 also include mating ratchet teeth and pawls as described above and an interlocking ridge and groove for axially locking the rotor to the housing also as described above.

Figure 16:
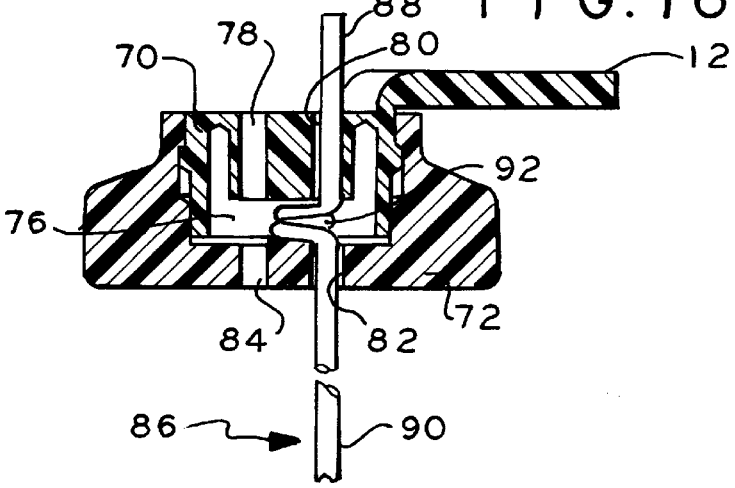
FIG. 16 is a side elevation sectional view of the embodiment of FIG. 15 with a wire inserted in an initial stage.

In operation, FIG. 16, a filament 86 has two ends 88 and 90, one of which, end 88, is initially inserted through the aligned bores 80 and 82. This end is passed linearly through the two aligned bores 80 and 82. The rotor 70 is then rotated. This rotation twists the filament end, e.g., 88, about the post 74 forming an initial twist or twists 92. The other end 90 is free and not attached at this time. The twist 92 may comprise one or more twists. The cavity 76 has ample room for the multiple twists.

The post 74 because it is square (or triangular and so on) has 90° or other angular extent corners which dig into the filament 86 as it wraps about the post 74. A round post is not preferred because the wrapped filament may tend to slide when pulled and thus permit the filament to be removed. If a sufficient number of twists are provided, then a round post may also serve the desired locking purpose. It is desired that the filament 86 can not be removed by pulling on it. The initial twist of end 88 may be provided by a factory for example. This would be the condition a user would receive the seal.

Figure 9:
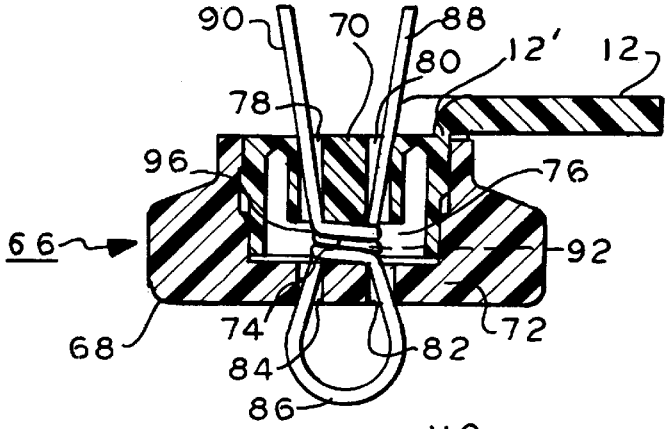
FIG. 9 is a side elevation sectional view of the embodiment of FIG. 7 with a sealing wire attached.

To secure the seal to a hasp and so on, the free filament 86 end 90 is passed through the hasp and then inserted in the aligned bores 78, 84, FIG. 16. The rotor 70 is again rotated. This twists the filament end 90 about the initial twists 92 or about the post 74 by making the post 74 of sufficient axially length to accommodate both sets of twists. This is shown in FIG. 9 and forms further twists 96 in the end 90. These further twists are locked in place to the post 74 locking the filament to the seal 66. Since the second set of twists 96 are wound about the initial set of twists 92, a sufficient number of twists are provided to insure the desired locking action.

In the alternative, both ends 88 and 90 may be inserted simultaneously into the respective aligned bores. Then the rotor is rotated wrapping both ends simultaneously about the post 74. In this way both ends are locked directly against the post 74 corners and each other.

Figure 10:
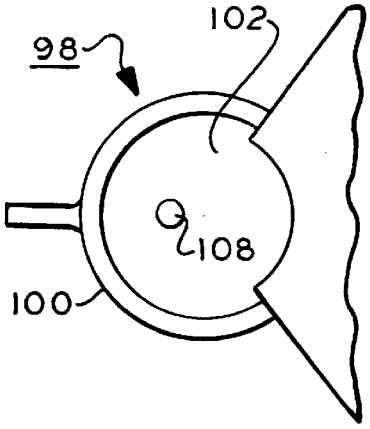
FIG. 10 is a top plan view of a seal in accordance with a third embodiment of the present invention.
Figure 11:
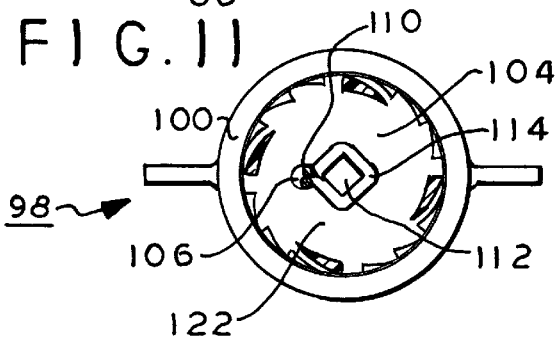
FIG. 11 is a top plan view of the housing and sectional view of the inserted rotor of the embodiment of FIG. 10 with a se aling wire attached.
Figure 12:
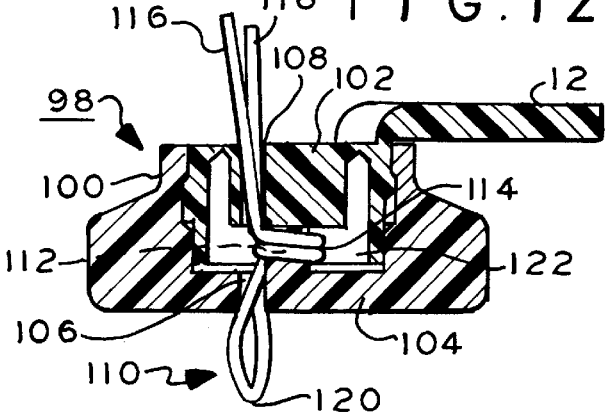
FIG. 12 is a side elevation sectional view of the embodiment of FIG. 10 with a sealing wire attached.

In FIGS. 10–12, seal 98 has a housing 100 and a rotor 102. The housing 100 has a bottom wall 104 with a single bore 106. The rotor also has a single bore 108. The bores 106 and 108 are of sufficient diameter to receive multiple lengths of filament 110 therethrough, e.g., at least two or more. In FIGS. 11 and 12, two doubled over lengths of filament are in each of bores 106 and 108. The housing and rotor are otherwise identical to the rotor and housing of FIG. 7. A square in plan view post 112 upstands from the bottom wall 104.

Both ends of the filament 110 are passed side-by-side in linear fashion through the aligned bores 106 and 108 in the housing and rotor. The rotor 102 is then rotated relative to the housing 100. This rotation twists both ends of the filament 110 in the bores about the post 112, FIG. 12. This forms twists 114 about the post of both ends 116 and 118 of the filament 110 and a loop 120 on the opposite side of the housing 100.

In the alternative, one 116 or 118 may be attached to the post 112 at a time. The filament is sufficiently small in diameter and flexible in this and in the above embodiments as to offer minimum resistance to multiple windings thereof about the post. In this case, both filament ends eventually are located in the same housing and rotor bores 108 and 106, respectively. The bores 106 and 108 may accommodate any number of filaments so that two or more different filaments may be attached to the same seal.

For example, one filament 110 may be locked to the seal 98 as in FIGS. 10–12. Later, a second filament (not shown) may also be locked to the same seal 98 using the same bores 106 and 108. The cavity 122 is sufficiently large to accommodate such additional twists.

Figure 13:
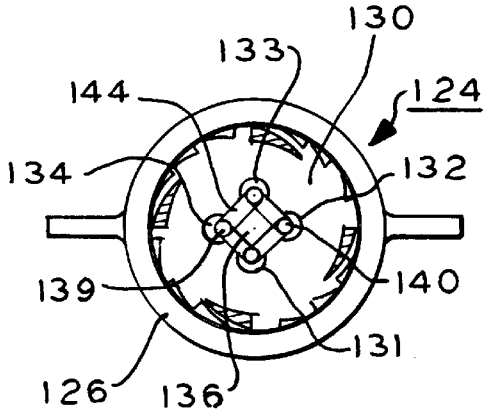
FIG. 13 is a top plan view of the housing and a sectional view of the inserted rotor of a fourth embodiment with four wire apertures and a sealing wire attached.
Figure 14:
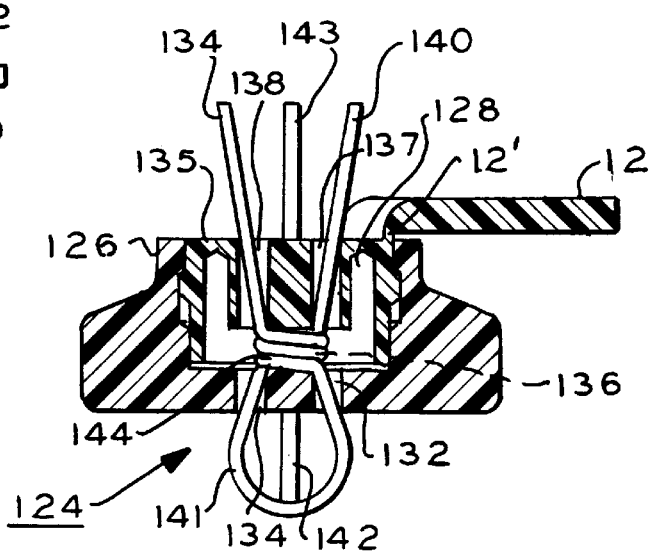
FIG. 14 is a side elevation sectional view of the embodiment of FIG. 13.
Figure 15:
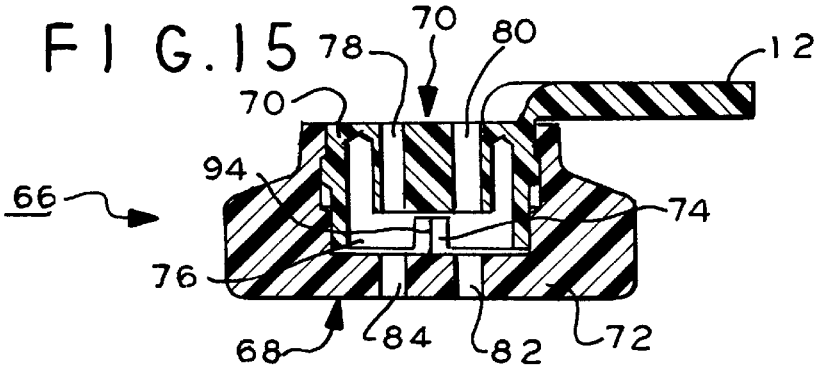
FIG. 15 is a side elevation sectional view of the embodiment of FIG. 9 without a wire inserted.

In FIGS. 13 and 14, a still further embodiment of a seal 124 includes a housing 126 and a rotor 128. The housing bottom wall 130 has four preferably equally spaced identical bores 131–134, inclusive, surrounding preferably square post 136. The rotor 135 has four corresponding aligned bores 137, 138 and two others not shown. The rotor and housing preferably are otherwise identical to the rotor and housings as previously described above.

In operation, a first filament 141 with two ends 139, 140 are secured to the seal 124 via bores 137, 138, 132 and 134. The filament ends 139 and 140 are twisted about and locked to the post 136 by rotating the rotor 128 as described above. A second filament 142 has its ends 143 (one being shown) passed through the other bores 131, 133 in the housing and two bores (not shown) in the rotor. The filament 142 is then attached to the post 136 by rotating the rotor again. This twists the filament 142 ends 143 (on being shown) to the post 136. The resulting twists 144 lock the two filaments to the post 136 and to the seal 124.

It will occur to one of ordinary skill that various modifications may be made to the disclosed embodiments. The embodiments are shown by way of illustration and not limitation. It is intended that the scope of the invention be defined by the appended claims. For example, while the post is shown secured to the housing, it may in the alternative depend from the rotor.

What is claimed is:

1. A rotatable security seal comprising a flexible filament:

a housing having a bottom wall and an annular side wall defining a chamber having an axis, said chamber being open at the housing top distal the bottom wall, said bottom wall having a first through-bore for receiving therethrough said flexible filament in an axial direction corresponding to said axis;

a rotor in the chamber for rotation about said axis relative to the housing and enclosing the top, the rotor having a second through-bore for receiving therethrough said received filament; and one way rotation means coupled to the rotor and to the housing for permitting the rotor to rotate about the axis only in one direction relative to the housing to twist the received filament in the chamber between the rotor and the housing.

2. The seal of claim 1 including rotor locking means coupled to the rotor and to the housing in the chamber for axially securing the rotor in the chamber.

3. The seal of claim 1 including a post secured to one of said rotor and housing in said chamber for receiving said twist of said filament wrapped thereabout.

4. The seal of claim 1 wherein said bores each are dimensioned relative to said filament for receiving a plurality of side-by-side filament portions therethrough.

5. The seal of claim 1 wherein the one way rotation means comprises ratchet teeth extending from one of the side wall and rotor into said chamber and at least one resilient pawl secured to the other of the rotor and side wall for engagement with the ratchet teeth.

6. The seal of claim 1 wherein the rotor has a top wall from which depends a central boss through which said second opening passes and an outer depending wall, an annular recess between said central boss and said outer depending wall, said recess terminating adjacent to said top wall for weakening said central boss relative to said outer depending wall.

7. The seal of claim 1 wherein the rotor has a top wall from which depends an outer wall and a central boss and weakening means in said rotor for weakening said boss relative to said outer wall.

8. The seal of claim 1 wherein the twisted filament has a twisted section, said rotor having a central boss through which said second bore passes, said central boss being spaced from said housing bottom wall for providing a cavity in the chamber for receiving said twisted section.

9. The seal of claim 3 wherein said post has sides forming angular corners about which the filament is twisted.

10. The seal of claim 1 including a plurality of said first bores in said bottom wall and a plurality of said second bores in said rotor, said first and second bores having an axially aligned condition in one angular position of said rotor.

11. The seal of claim 10 wherein the first and second bores are respectively axially aligned in an initial position of said rotor relative to the housing.

12. The seal of claim 1 wherein the bottom wall has a plurality of said first bores and the rotor has a plurality of said second bores, said rotor having a top wall from which depends a central boss through which said second bores pass and an outer depending wall, the rotor having an annular recess between said central boss and said outer depending wall, said one way rotation means including a radially resilient pawl depending from said outer depending wall, said housing including a plurality of radially inwardly facing ratchet teeth engaged with said pawl.

13. The seal of claim 1 including a plurality of first and second bores wherein the first and second bores terminate at respective housing and rotor surfaces at about right angles to form a relatively sharp edge with said surfaces and are spaced apart a distance having a value which cooperates with said edges to slidably axially secure the twisted filament to the housing and rotor at said edges.

14. The seal of claim 1 further including rotor locking means for axially locking the rotor to the housing comprising complementary mating surface features in the rotor and housing in said chamber.

15. The seal of claim 1 including a pair of said first bores and a pair of said second bores, each first bore having a corresponding second bore.

16. The seal of claim 15 including a further pair of first bores and a further pair of second bores, a bore of each pair corresponding to each other and being aligned in an initial position of the rotor to the housing.

17. The seal of claim 1 including a manual gripping flange on each said rotor and housing.

18. The seal of claim 1 including a flange attached to the rotor, said flange including a weakened section for separating the flange from the rotor when stressed.

19. The seal of claim 17 wherein the rotor flange has a weakened section.

20. A rotatable security seal comprising a flexible filament:

a housing having a bottom wall and an annular side wall forming a circular cylindrical chamber defining an axis, said chamber being open at the housing top distal the bottom wall, said bottom wall having at least one first through-bore for receiving therethrough said flexible filament in an axial direction;

a rotor in the chamber for rotation about said axis relative to the housing and enclosing the housing top, the rotor having a central boss with at least one second through-bore aligned with the at least one first bore in an initial position of the rotor for receiving therethrough said received filament;

locking means comprising complementary mating surface features coupled to the rotor and to the housing in the chamber for axially securing the rotor in the chamber; and one way rotation means comprising a plurality of radially movable pawls and a plurality of annularly spaced ratchet teeth engaged with the pawls coupled to the rotor and to the housing in the chamber for permitting the rotor to rotate about the axis only in one direction relative to the housing to twist the received filament in a cavity in the chamber between the boss and the housing bottom wall.

21. The seal of claim 20 including a post secured to one of the housing and rotor in said chamber for receiving thereabout the twisted filament.

22. The seal of claim 20 including a plurality of said first and second bores wherein the first bores and the second bores are respectively radially spaced apart a distance and the edges of the bores each having a value so as to cooperate in assisting in axially locking the twisted filament to the housing and rotor in the cavity.

23. A rotatable security seal comprising a flexible filament:

a housing having a bottom wall and an annular side wall defining a chamber having an axis, the chamber being open at the housing top distal the bottom wall, the bottom wall having first and second through-bores for receiving therethrough said flexible filament in an axial direction;

a rotor in the chamber for rotation about the axis relative to the housing, the rotor having third and fourth through-bores for receiving therethrough the received filament;

rotor locking means coupled to the rotor and to the housing in the chamber for axially securing the rotor in the chamber; and one way rotation means coupled to the rotor and to the housing for permitting the rotor to rotate about the axis only in one direction relative to the housing to twist the received filament in the chamber between the rotor and the housing.

* * * * *